US006780105B1

(12) United States Patent
Kaminkow

(10) Patent No.: US 6,780,105 B1
(45) Date of Patent: Aug. 24, 2004

(54) GAMING DEVICE HAVING A MULTIPLE SCREEN BONUS ROUND

(75) Inventor: Joseph E. Kaminkow, Reno, NV (US)

(73) Assignee: IGT, Reno, NV (US)

( * ) Notice: Subject to any disclaimer, the term of this patent is extended or adjusted under 35 U.S.C. 154(b) by 221 days.

(21) Appl. No.: 09/629,235

(22) Filed: Jul. 31, 2000

(51) Int. Cl.[7] ..... A63F 9/24
(52) U.S. Cl. ..... 463/16; 463/25; 273/138.1
(58) Field of Search ..... 463/1, 16–20, 463/30, 31; 273/138.1, 138.2, 143 R, 139; 345/1.1, 1.3, 2.1, 2.2, 3.1

(56) References Cited

U.S. PATENT DOCUMENTS

| | | | | |
|---|---|---|---|---|
| 4,621,814 A | | 11/1986 | Stepan et al. | |
| 5,342,047 A | | 8/1994 | Heidel et al. | |
| 5,449,173 A | | 9/1995 | Thomas et al. | |
| 5,560,603 A | * | 10/1996 | Seelig et al. | 463/6 |
| D392,340 S | | 3/1998 | DeSimone | |
| 5,766,074 A | | 6/1998 | Cannon et al. | |
| 5,772,509 A | | 6/1998 | Weiss | |
| 5,807,172 A | | 9/1998 | Piechowiak | |
| 5,911,418 A | | 6/1999 | Adams | |
| 5,976,016 A | * | 11/1999 | Moody et al. | 463/13 |
| 6,089,978 A | | 7/2000 | Adams | |
| 6,126,165 A | | 10/2000 | Sakamoto | |
| 6,135,884 A | | 10/2000 | Hedrick et al. | |
| 6,176,781 B1 | * | 1/2001 | Walker et al. | 463/13 |
| 6,254,481 B1 | * | 7/2001 | Jaffe | 463/20 |
| 6,287,197 B1 | * | 9/2001 | Dickinson et al. | 463/31 |

FOREIGN PATENT DOCUMENTS

| | | |
|---|---|---|
| EP | 0874337 A1 | 10/1998 |
| EP | 0945837 A2 | 9/1999 |
| EP | 0984409 A2 | 3/2000 |
| WO | WO 9732285 | 9/1997 |
| WO | WO 0012186 | 3/2000 |

OTHER PUBLICATIONS

Jackpot Party Brochures & Articles published by WMS Gaming, Inc. in 1998.

Dual Screen Keno Machine Picture

Cast for Cash Brochure and Website published by WMS Gaming, Inc.

Picture in Picture Description.

* cited by examiner

*Primary Examiner*—Mark Sager
*Assistant Examiner*—Steven Ashburn
(74) *Attorney, Agent, or Firm*—Bell, Boyd & Lloyd, LLC

(57) ABSTRACT

The present invention includes a bonus round of a gaming device wherein a video display contains multiple or split screens displayed at one time. Each of the screens preferably displays indicia relating to a single event employed by the game, and thus each of the screens preferably displays indicia relating to the other screens of the display. The screens preferably present the event a chronological or otherwise sequential manner. The screens can show different views of the event occurring at one time of the event and can show the same view of different times of the event in one display. At some point, in accordance with the event or theme of the bonus round, the game provides an award to the player in such a way that is exciting to the player. The game can employ one or more of the screens in awarding the player, wherein one or more screens displays the award, and wherein other screens celebrate the award.

53 Claims, 11 Drawing Sheets

FIG. 5

64

| | NO. OF VIEWS DISPLAYED | TIME OF THE EVENT | NUMBER OF SCREENS EMPLOYED |
|---|---|---|---|
| 66 | Same View | Same Time | Different Screens |
| 68 | Same View | Different Times | Same Screen |
| 70 | Same View | Different Times | Different Screens |
| 72 | Different View | Same Time | Same Screen |
| 74 | Different View | Same Time | Different Screens |
| 76 | Different View | Different Times | Different Screens |
| 78 | Different View | Different Times | Same Screen |

GAMING DEVICE HAVING A MULTIPLE SCREEN BONUS ROUND

CROSS-REFERENCE TO RELATED APPLICATIONS

This application is related to the following commonly-owned co-pending patent applications: "GAMING DEVICE WITH TRAVELING REEL SYMBOLS," Ser. No. 09/606,928; "GAMING DEVICE HAVING PYRAMID BONUS SCHEME," Ser. No. 09/656,702; "GAMING DEVICE HAVING SEPARATELY CHANGEABLE VALUE AND MODIFIER BONUS SCHEME," Ser. No. 09/626,045; "GAMING DEVICE HAVING SELECTIVELY ACCESSIBLE BONUS SCHEME," Ser. No. 09/657,916; "GAMING DEVICE HAVING MULTIPLE AWARD ENHANCING LEVELS," Ser. No. 09/626,720; "GAMING DEVICE WITH MULTI-PURPOSE REELS," Ser. No. 09/606,733; "GAMING DEVICE HAVING A WEIGHTED PROBABILITY FOR SELECTING A BONUS GAME," Ser. No. 09/680,346; "GAMING DEVICE HAVING A METHOD FOR RANDOMLY GENERATING A BONUS ROUND OUTCOME," Ser. No. 09/679,25 1; "GAMING DEVICE HAVING A BONUS ROUND WITH MULTIPLE RANDOM AWARD GENERATION AND MULTIPLE RETURN/RISK SCENARIOS," Ser. No. 09/678,989; "GAMING DEVICE WITH MOVING SCREEN SIMULATION," Ser. No. 09/625,884; "GAMING DEVICE HAVING BONUS SCHEME WITH INCREMENTAL VALUE DISCLOSURE," Ser. No. 09/627,198; "GAMING DEVICE WITH PRIZE BONUS SCHEME HAVING MULTIPLE AWARD LEVELS," Ser. No. 09/602,140; "GAMING DEVICE WITH SIGNIFIED REEL SYMBOLS," Ser. No. 09/605,344; "GAMING DEVICE HAVING COMPETITION BONUS SCHEME," Ser. No. 09/628,144; "GAMING DEVICE HAVING TOUCH ACTIVATED ALTERNATING OR CHANGING SYMBOL," Ser. No. 09/602,331; "GAMING DEVICE PROVIDING TOUCH ACTIVATED SYMBOL INFORMATION," Ser. No. 09/680,349; "GAMING DEVICE HAVING A MULTIPLE SELECTION GROUP BONUS ROUND," Ser. No. 09/605,107; "GAMING DEVICE HAVING A REPLICATING DISPLAY THAT PROVIDES WINNING PAYLINE INFORMATION," Ser. No. 09/629,606; "GAMING DEVICE PROVIDING AUDIO WAGERING INFORMATION," Ser. No. 09/629,288; "GAMING DEVICE HAVING A CHANGEABLE OBJECT," Ser. No. 09/680,111; "GAMING DEVICE HAVING MULTIPLE AUDIO, VIDEO OR AUDIO-VIDEO EXHIBITIONS ASSOCIATED WITH RELATED SYMBOLS," Ser. No. 09/689,529; "GAMING DEVICE HAVING A MULTI-ROUND BONUS SCHEME WHEREIN EACH ROUND HAS A PROBABILITY OF SUCCESS," Ser. No. 09/688,441; "GAMING DEVICE HAVING MULTIPLE CHOICE LARGE AWARD BONUS SCHEME," Ser. No. 09/686,284; "GAMING DEVICE HAVING INTERACTING SYMBOLS," Ser. No. 09/686,308; "GAMING DEVICE WITH TRAVELING REEL SYMBOLS," Ser. No. 09/689,197; "GAMING DEVICE HAVING A SYMBOL COVERING FEATURE," Ser. No. 09/684,275; "GAMING DEVICE HAVING RELATED MULTI-GAME BONUS SCHEME," Ser. No. 09/688,972; "GAMING DEVICE WITH A BONUS SCHEME HAVING REPEATED SELECTION OF VALUE SETS WITH OPTION TO SAVE VALUES," Ser. No. 09/684,533; and "GAMING DEVICE HAVING A PRIMARY GAME SCHEME INVOLVING A SYMBOL GENERATOR AND SECONDARY AWARD TRIGGERING GAMES," Ser. No. 09/689,495.

COPYRIGHT NOTICE

A portion of the disclosure of this patent document contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having a bonus round with a video display simultaneously showing multiple screens.

BACKGROUND OF THE INVENTION

Gaming machines currently exist with bonus rounds in which a player has one or more opportunities to choose bonus awards that are initially masked from a group of symbols arranged in a pattern displayed to the player. When the player chooses a masked symbol from the pattern, the game removes the mask and either reveals (or awards) the player with a bonus value or reveals a bonus terminator which terminates the bonus round. The outcome depends upon whether the player picks an award or terminator. The controller of the gaming machine randomly places a predetermined number of bonus awards and bonus terminators in the pattern at the beginning of the bonus round and maintains the positioning until the bonus round terminates.

When the player picks a symbol that awards a bonus value, the player receives bonus credits and the bonus round typically displays a message that the player may continue and enables the player to pick another symbol. The player then picks another masked symbol, and the process continues until the player picks a bonus round terminator. European Patent Application No. EP 0 945 837 A2 filed on Mar. 18, 1999 and assigned on its face to WMS Gaming, Inc. discloses a bonus round of this type.

To increase player enjoyment and excitement, it is desirable to provide players with new bonus rounds wherein the players have opportunities to receive one or more awards. In particular, it is desirable to provide players with opportunities to receive valuable awards and display the awards in a manner that provides entertainment and enjoyment to the player. It is also desirable to present a theme while displaying the awards, with which the player is familiar, and which provides entertainment and enjoyment to the player.

SUMMARY OF THE INVENTION

The present invention includes a bonus round wherein a video monitor contains multiple or split screens displayed simultaneously. The game is adapted to display a different number of screens at different points or times during the bonus round. Each of the screens can display the same or different video or images as the other screens. The screens can display static, animated, computer generated and/or motion picture images. Each of the screens preferably displays images relating to a single event or theme employed by the game, and thus each of the screens preferably displays indicia relating to the other screens of the display. The present invention preferably provides suitable audio sounds, voices and music that correspond to and enhance the event or theme and the player's level of excitement.

The screens preferably present the event or theme in a chronological or otherwise sequential manner. The screens can also show different views or images of the event or theme occurring at one time of the event or theme. Different screens can display separate views, images or actions within the theme or event and, alternatively, the different screens can also display the same view, image or actions to emphasize such displays. Certain screens can contain or display no views or images or blank views or images of the theme, so that the game highlights the screen or screens that are presenting views or images of the theme. Thereafter, the game can add images to previously empty or non-image displaying screens.

The event or theme of the bonus round preferably relates to a topic that provides entertainment and enjoyment to the player. The event or theme is also preferably recognizable by many people so that the present invention can entertain a large percentage of the players. At some point, in accordance with the event or theme of the bonus round, the game provides an award to the player in such a way that is exciting to the player. The game can employ one or more of the screens in awarding the player, in which one or more screens preferably displays the award, and wherein the other screens present images celebrating the award.

It is therefore an object of the present invention to provide a gaming device with a bonus round that provides players with one or more opportunities to receive awards and display the awards in a manner that provides entertainment and enjoyment to the player.

Another object of the present invention is to display an event or theme while displaying a bonus award, with which the player is familiar, and which provides entertainment and enjoyment to the player.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIG. 5 is a chart containing a non-inclusive list of combinations of views, times and screens of the present invention;

DETAILED DESCRIPTION OF THE INVENTION

Gaming Device and Electronics

Figure 1:
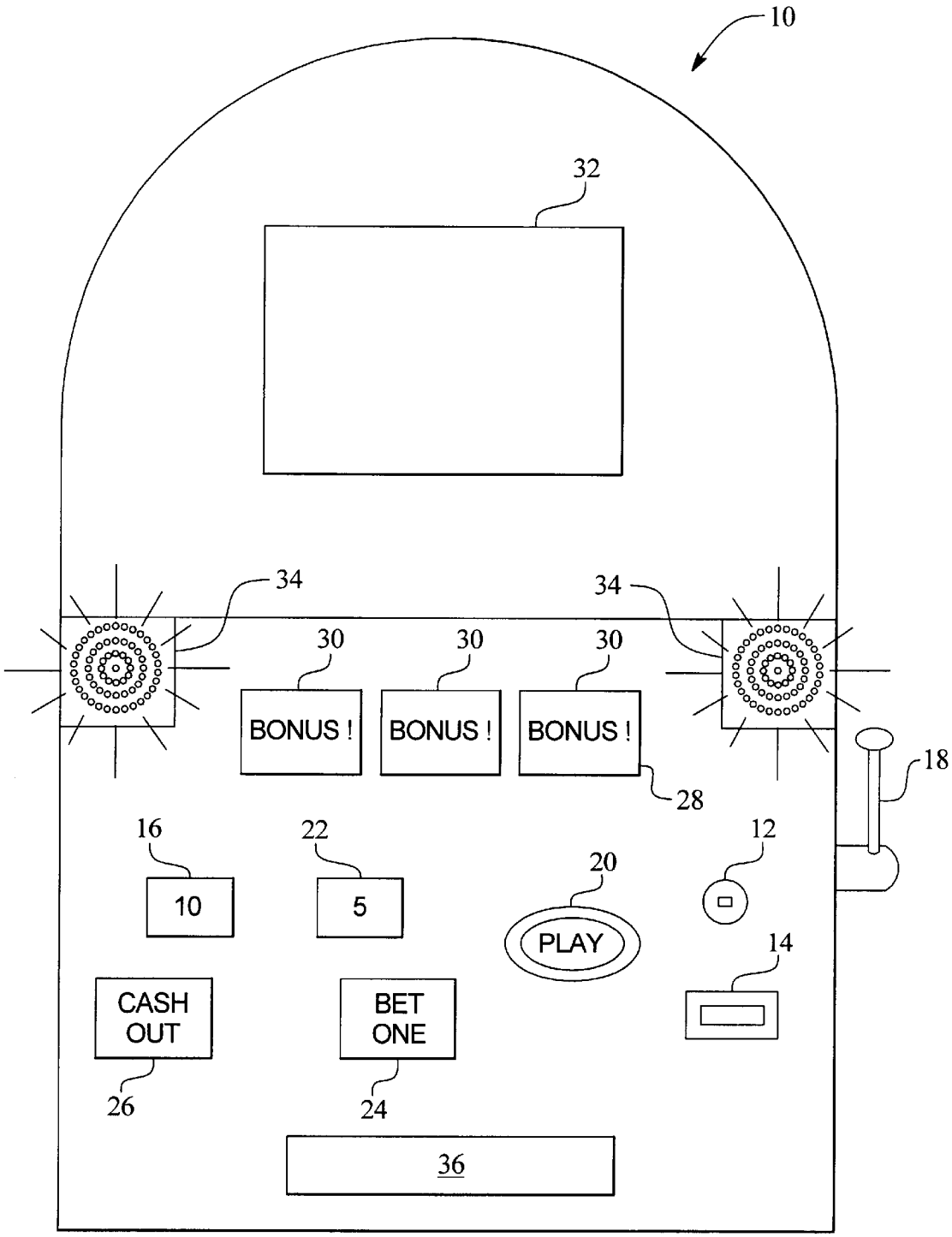
FIG. 1 is a front plan view of one embodiment of the gaming device of the present invention.

Referring now to the drawings, FIG. 1 generally illustrates a gaming device 10 of one embodiment of the present invention, which is preferably a slot machine having the controls, displays and features of a conventional slot machine. Gaming device 10 is constructed so that a player can operate gaming device 10 while standing or sitting. However, it should be appreciated that gaming device 10 can be constructed as a pub-style table-top game (not shown) that a player can operate preferably while sitting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform. Gaming device 10 can incorporate any game such as slot, poker or keno. The symbols used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. The present invention preferably employs or uses credits, however, the present invention is not limited to the use of credits and contemplates employing other units of value such as money. For purposes of describing and claiming this invention, the term "credit" includes any unit of value such as a gaming device credit or actual money.

After depositing the appropriate amount of money, a player can begin the game by pulling arm 18 or by pushing play button 20. Play button 20 can be any play activator used by the player which starts any game or sequence of events in the gaming device.

Referring to FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 also has a paystop display 28 which contains a plurality of reels 30, preferably three to five reels in mechanical or video form. Each reel 30 displays a plurality of symbols such as bells, hearts, martinis, fruits, cactuses, numbers, cigars, letters, bars or other images, which preferably correspond to a theme associated with the gaming device 10. If the reels 30 are in video form, the gaming device 10 preferably displays the video reels 30 in a video monitor described below. Furthermore, gaming device 10 preferably includes speakers 34 for making sounds or playing music.

At any time during the game, a player may "cash out" and thereby receive a number of coins corresponding to the number of remaining credits by pushing a cash out button 26. When the player "cashes out," the player receives the coins in a coin payout tray 36. The gaming device 10 may employ other payout mechanisms such as credit slips redeemable by a cashier or electronically recordable cards that keep track of the player's credits.

With respect to electronics, the controller of gaming device 10 preferably includes the electronic configuration generally illustrated in FIG. 2, which has: a processor 38; a memory device 40 for storing program code or other data; a video monitor 32 (i.e., a liquid crystal display) described in detail below; a plurality of speakers 34; and at least one input device as indicated by block 33. The processor 38 is preferably a microprocessor or microcontroller-based platform that is capable of displaying images, symbols and other indicia such as images of people, characters, places, things and faces of cards. The memory device 40 can include random access memory (RAM) 42 for storing event data or other data generated or used during a particular game. The memory device 40 can also include read only memory (ROM) 44 for storing program code, which controls the gaming device 10 so that it plays a particular game in accordance with applicable game rules and pay tables.

Figure 2:
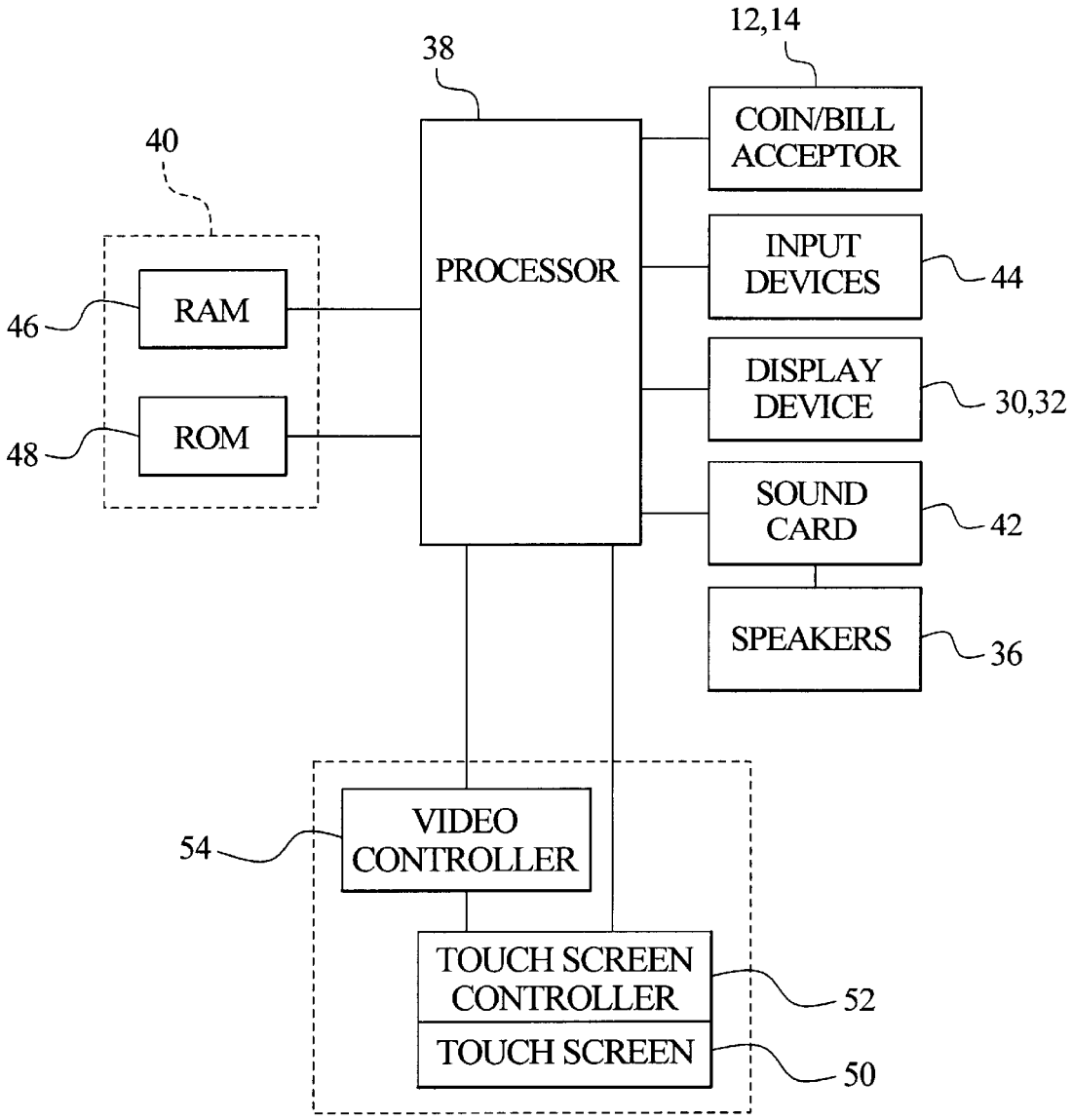
FIG. 2 is a schematic block diagram of the electronic configuration of one embodiment of the gaming device of the present invention.

As illustrated in FIG. 2, the player preferably uses the input devices 33, such as the arm 18, play button 20, the bet one button 24 and the cash out button 26 to input signals into gaming device 10. In certain instances, a touch screen 46 and an associated touch screen controller 48 can be used in conjunction with a video monitor described in detail below. Touch screen 46 and touch screen controller 48 are connected to a video controller 50 and processor 38. A player can make decisions and input signals into the gaming device 10 by touching touch screen 46 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. For purposes of describing the invention, the controller includes the processor 38 and memory device 40.

With reference to FIGS. 1 and 2, to operate the gaming device 10, the player must insert the appropriate amount of money or tokens at coin slot 12 or bill acceptor 14 and then pull the arm 18 or push the play button 20. The reels 30 will then begin to spin. Eventually, the reels 30 will come to a stop. As long as the player has credits remaining, the player can spin the reels 30 again. Depending upon where the reels 30 stop, the player may or may not win additional credits.

In addition to winning credits in this manner, gaming device 10 also preferably gives players the opportunity to win credits in a bonus round. This type of gaming device 10 will include a program that will automatically begin a bonus round when the player has achieved a qualifying condition in the game. This qualifying condition can be a particular arrangement of indicia on the display window 28. The gaming device 10 also includes a display device such as a display device 32 shown in. FIG. 1 enabling the player to play the bonus round. Preferably, the qualifying condition is a predetermined combination of indicia appearing on a plurality of reels 30. As illustrated in the three reel slot game shown in FIG. 1, the qualifying condition could be the text "BONUS!" appearing in the same location on three adjacent reels.

Apparatus of the Invention

Figure 3:
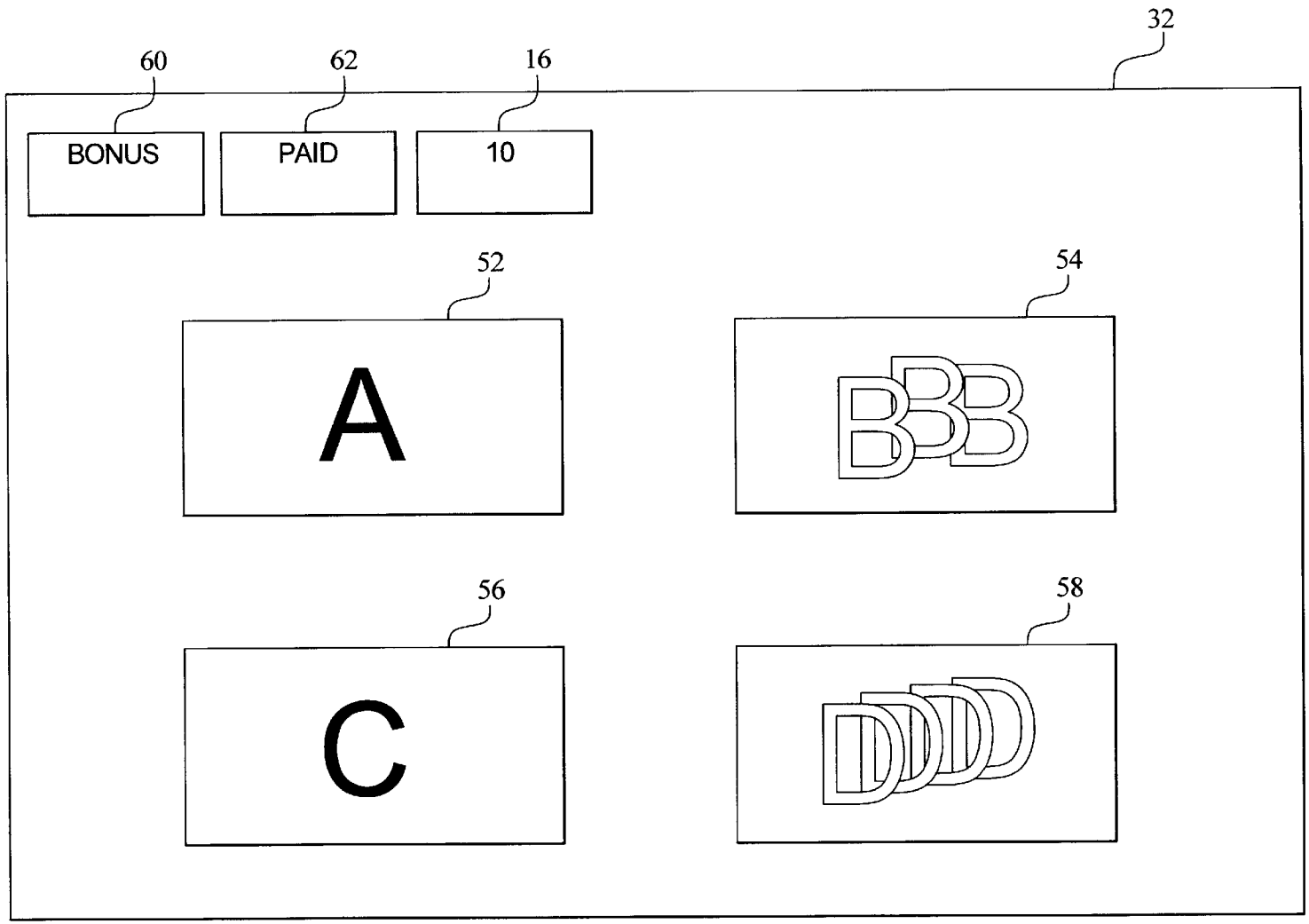
FIG. 3 is an enlarged front plan view of the display device of the present invention having a plurality of screens displayed at once.

Referring now to FIG. 3, a general embodiment of the present invention is shown wherein the display device 32 contains a plurality of screens 52, 54, 56 and 58. The present invention can employ any number of screens and preferably provides four screens. The display device 32 can have a different number of screens at different points in the bonus round. The display device can also contain other indicators such as a bonus indicator 60 that displays a number of credits or awards amassed during the round, a paid indicator 62 that displays a number of bonus round credits paid to the player, and the credit meter 16 described above. If the display device 32 also contains a touch screen 46, then the display device can also contain suitable input devices 33 to enable the player to input decisions into the controller.

The display device 32 simultaneously displays the separate screens 52, 54, 56 and 58. Each screen can display separate and different images from any other screen or have the same image as one or more of the other screens. Each screen can display different types of images. A screen can contain a static image, wherein the screen displays the same image for an extended period of time. The static images can contain an animated image, computer generated image or a picture. A screen can alternatively contain a moving or changing image, wherein the screen displays the images moving over time. The moving images can likewise contain a plurality of animated or computer generated images or a plurality of pictures. It should be appreciated that the video monitor can display an actual video, motion picture or a digitized or computer generated image.

The display device 32 can contain different screens, such as the screens 52 through 58, wherein different screens have static, dynamic, animated, computer generated or picture images. For example, in the display device 32 of FIG. 3, the screen 52 can display the "A" as a static, (i.e., unchanging over time), animated or computer generated image. At the same time, the screen 54 can display the "B" as a moving, animated or computer generated image. At the same time, the screen 56 can display the "C" as a static picture. At the same time, the screen 58 can display the "D" as a moving or motion picture, i.e., a video or movie. Display device 32 can contain any combination of static, dynamic, animated, computer generated and picture screens.

Figure 4A:
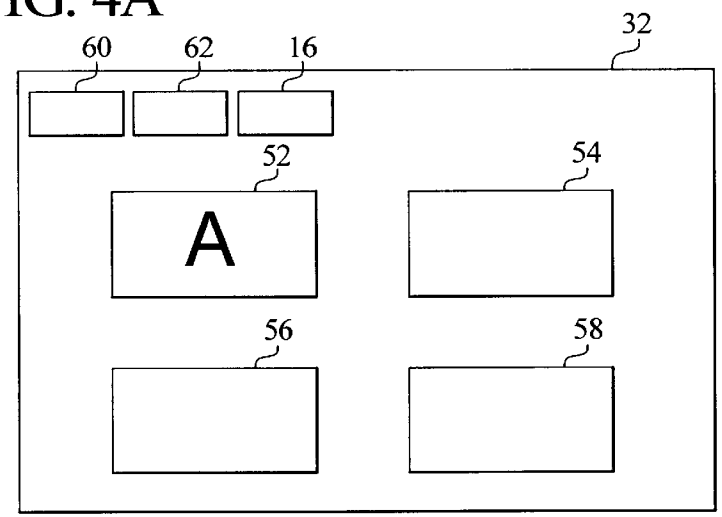
FIG. 4A is a front plan view of the display device of the present invention illustrating one set of screens in a sequence of sets.
Figure 4B:
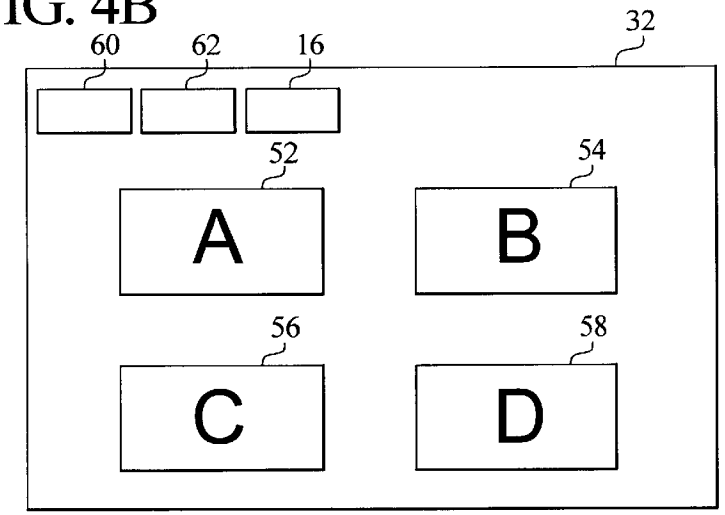
FIG. 4B is a front plan view of the display device of the present invention illustrating a second set of screens in a sequence of sets.
Figure 4C:
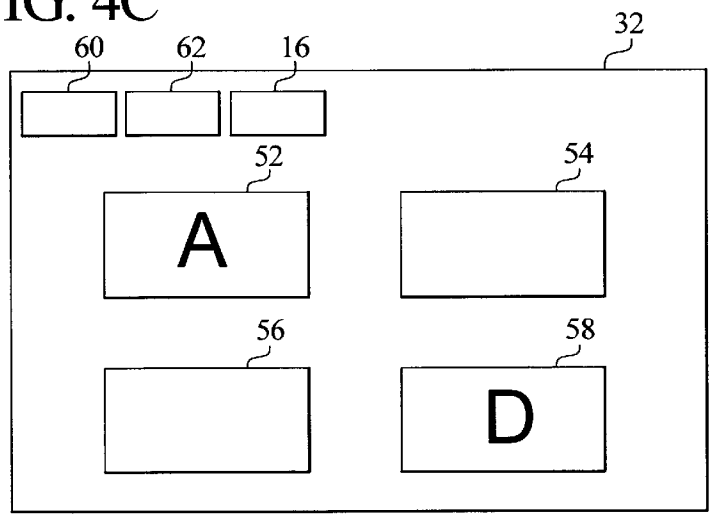
FIG. 4C is a front plan view of the display device of the present invention illustrating a third set of screens in a sequence of sets.
Figure 4D:
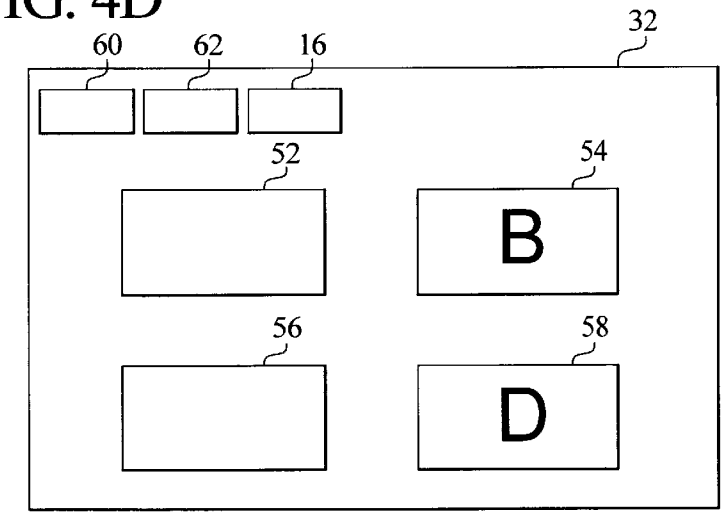
FIG. 4D is a front plan view of the display device of the present invention illustrating a fourth set of screens in a sequence of sets.

Referring to FIGS. 4A through 4D, the display device 32 is shown illustrating the game's ability to sequence images in the screens. In FIG. 4A, the display device 32 contains the screens 52, 54, 56 and 58. Screen 52 displays the "A" image, while the remainder of the screens 54, 56 and 58 display blank images. At a later time in FIG. 4B, the display device 32 contains the same screens 52 though 58, which display the "A", "B", "C" and "D" images, respectively. At a later time in FIG. 4C, the display device 32 still contains the screens 52 through 58, in which the screen 52 displays the "A" image and the screen 58 displays the "D" image. At a final time in FIG. 4D, the display device 32 again contains the screens 52 through 58, in which the screen 54 displays the "B" image and the screen 58 displays the "D" image. The screens displaying no indicia (i.e., displaying none of "A", "B", "C" or "D") can have no image, i.e., no projection by the display device 32 or a blank image, i.e., a projection of a single color or pattern.

The screens preferably display images that make up or comprise an event or theme. The event or theme can be any event or theme that the implementor of the bonus round desires. The event or theme is preferably well known so that many people can play and enjoy the bonus round. The event or theme also preferably brings excitement and enjoyment in real life so that the event or theme also brings excitement and enjoyment in the bonus round. The events or themes are not limited to but can be, for example, holidays, a birthday, an adventure or a trip.

The present invention preferably presents the player with an award and displays the award in conjunction with the event or theme of the bonus round so that the receipt of the award provides excitement and enjoyment to the player. The game can show the player a number of possible awards before selecting an award, i.e., show the player that the game is "thinking of" or "contemplating" the player's award. Alternatively, the game can make the player play bonus game to receive an award or the game can merely present the player with an award. The awards can be a number of base game credits or a multiplier that multiplies some value, such as a base game award or an amount of base game credits that the player has bet.

The present invention preferably provides audio productions in the form of voice, sound effects or music to accompany the displays of the different screens. The audio productions can appear to accompany one of the individual screens, e.g., the speakers 34 of the gaming device 10 emit the sound of a voice, while one of the screens displays a person talking. Alternatively, the audio productions can appear to accompany each of the screen displays, e.g., the speakers 34 of the gaming device 10 emit music that does not distinguish any one of the displays.

The screens display different views or images that make up or comprise the event or theme. Since the display device preferably contains more than one screen, the implementor of the bonus round can employ the multiple screens in a plurality of ways that present the theme in an entertaining and exciting manner. The game can display images sequentially as the event unfolds in one screen. The game can also display images sequentially as the events unfold in multiple screens. Employing multiple screens enables the game to present different views of the event occurring at the same time of the event. Employing multiple screens also enables the game to present views of the event that have occurred at different times during the event.

Referring now to FIG. 5, a chart 64 is shown having the seven combinations 66 through 78, each of which vary from the others in terms of the views and times of the event displayed and the number of screens employed. The chart 64 shows the variations of the present invention, i.e., the combinations that the present invention can employ. The chart 64 is illustrative and does not limit the present invention to the combinations discussed. The present invention can employ a plurality of the combinations discussed in detail below, at one time, in different screens of the display device 32 and thus is not limited to only displaying one of the combinations discussed below.

Figure 6:
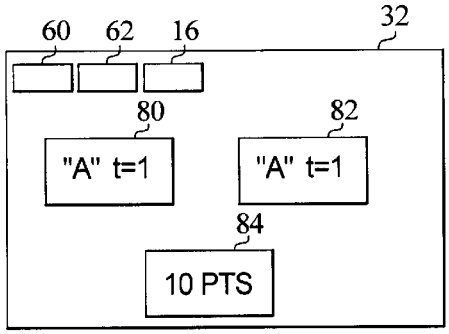
FIG. 6 is a front plan view of the display device illustrating one combination of views, times and screens of the present invention.

Referring to the combination 66 of FIG. 5, the present invention can display the same view or image of the same time of an event in a plurality of screens. Referring to FIG. 6, an example of the combination 66 is displayed, wherein an image or view of the letter "A" at the time t=1, is shown in screens 80 and 82, i.e., a plurality of screens. The present invention can employ the combination 66, for example, to highlight an image or view in a single screen not displaying the letter "A". For example, while the screens 80 and 82 each display the letter "A", the screen 84 displays and highlights an award.

Figure 7:
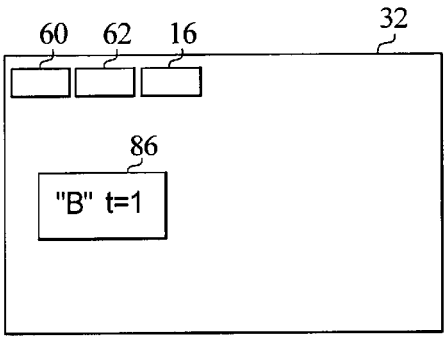
FIGS. 7 and 8 are front plan views of the display device illustrating a second combination of views, times and screens of the present invention.
Figure 8:
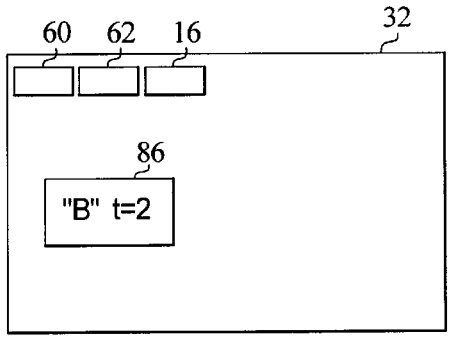

Referring to the combination 68 of FIG. 5, the present invention can display the same view or image at different times of an event in a single screen. Referring to FIGS. 7 and 8, an example of the combination 68 is displayed, wherein an image or view of the letter "B" at the time t=1 is shown in the screen 86 of FIG. 7, while an image or view of the letter "B" at the time t=2 is shown in the same screen 86 of FIG. 8. The combination 68 covers a single video view or image, such as a security camera that is shown on one screen in real, sped-up, or slowed time.

Figure 9:
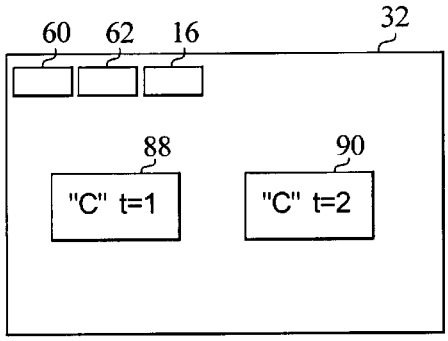
FIG. 9 is a front plan view of the display device illustrating a third combination of views, times and screens of the present invention.

Referring to the combination 70 of FIG. 5, the present invention can display the same view or image at different times of an event in different screens. Referring to FIG. 9, an example of the combination 70 is displayed, wherein an image or view of the letter "C" at the time t=1 is shown in the screen 88, while an image or view of the letter "C" at the time t=2 is shown in a different screen 90. The combination 70 covers a static or dynamic delay of the same view or image.

Figure 10:
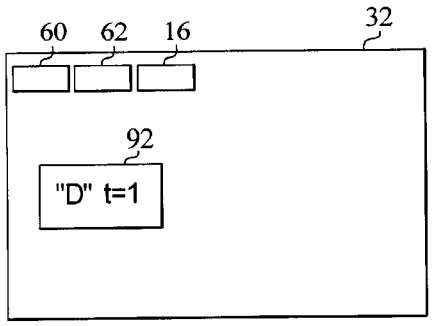
FIGS. 10 and 11 are front plan views of the display device illustrating a fourth combination of views, times and screens of the present invention.
Figure 11:
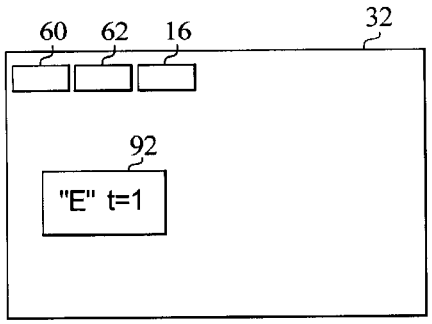

Referring to the combination 72 of FIG. 5, the present invention can display different views or images of the same time of an event in a single screen. Referring to FIGS. 10 and 11, an example of the combination 72 is displayed, wherein an image or view of the letter "D" at the time t=1 is shown in the screen 92 of FIG. 10, while an image of the letter "E" at the time t=1 is shown in the screen 92 of FIG. 11. The combination 72 covers a situation such as consecutively displaying two different photographs taken of the same person at the same time in a single screen.

Figure 12:
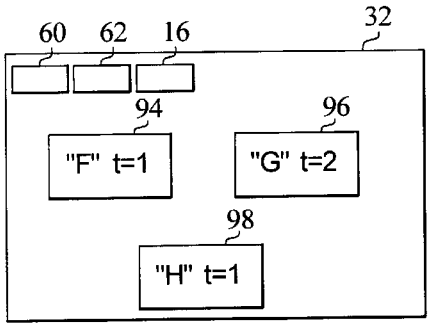
FIG. 12 is a front plan view of the display device illustrating a fifth combination of views, times and screens of the present invention.

Referring to the combination 74 of FIG. 5, the present invention can display different views or images of the same time of an event in different screens. Referring to FIG. 12, an example of the combination 74 is displayed, wherein an image or view of the letter "F" at the time t=1 is shown in the screen 94, an image or view of the letter "G" at the time t=1 is shown in the screen 96 and an image or view of the letter "H" at the time t=1 is shown in the screen 98. The combination 74 covers multiple static or dynamic displays of the same time, step or stage of an event, e.g. displaying multiple security camera images as the cameras film the same area (event) of a room.

Figure 13:
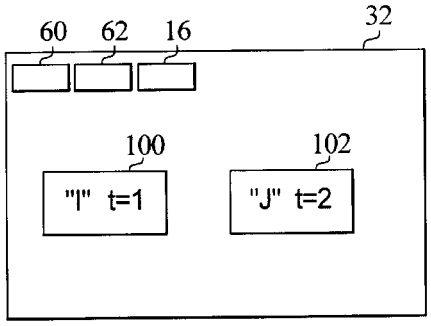
FIG. 13 is a front plan view of the display device illustrating a sixth combination of views, times and screens of the present invention.

Referring to the combination 76 of FIG. 5, the present invention can display different views or images of different times of an event in different screens. Referring to FIG. 13, an example of the combination 76 is displayed, wherein an image or view of the letter "I" at the time t=1 is shown in the screen 100 and an image or view of the letter "J" at the time t=2 is shown in the screen 102. The combination 76 covers a situation such as a scrapbook having different pictures or views taken at different times of an event, which are displayed on a single page or screen.

Figure 14:
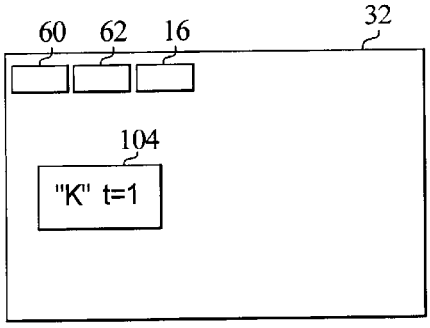
FIGS. 14 and 15 are front plan views of the display device illustrating a seventh combination of views, times and screens of the present invention.
Figure 15:
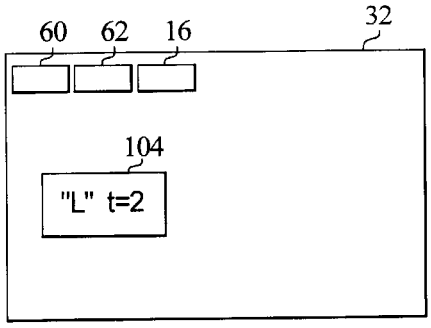

Referring to the combination 78 of FIG. 5, the present invention can display different views or images of different times of an event in a single screen. Referring to FIGS. 14 and 15, an example of the combination 78 is displayed, wherein an image or view of the letter "K" at the time t=1 is shown in the screen 104 of FIG. 14, while an image of the letter "L" at the time t=2 is shown in the screen 104 of FIG. 15. The combination 78 covers a situation such as a movie or motion picture occurring on one screen, wherein the single screen displays multiple views or images that jump backward or forward along the timeline of an event or story.

FIGS. 16 through 21 illustrate one embodiment having many of the features and aspects of the present invention described above. The different screens of the different displays portray an event or theme, which is the well known New Year's Eve countdown celebration in New York City's Time Square. The event is hosted by a popular and well-known television personality. The different screens comprise television sets and create the impression of a television station's editing room, wherein the station has many cameras positioned at different large cities in the United States. The editing room of the television station receives and displays each of the signals that it is filming.

Figure 16:
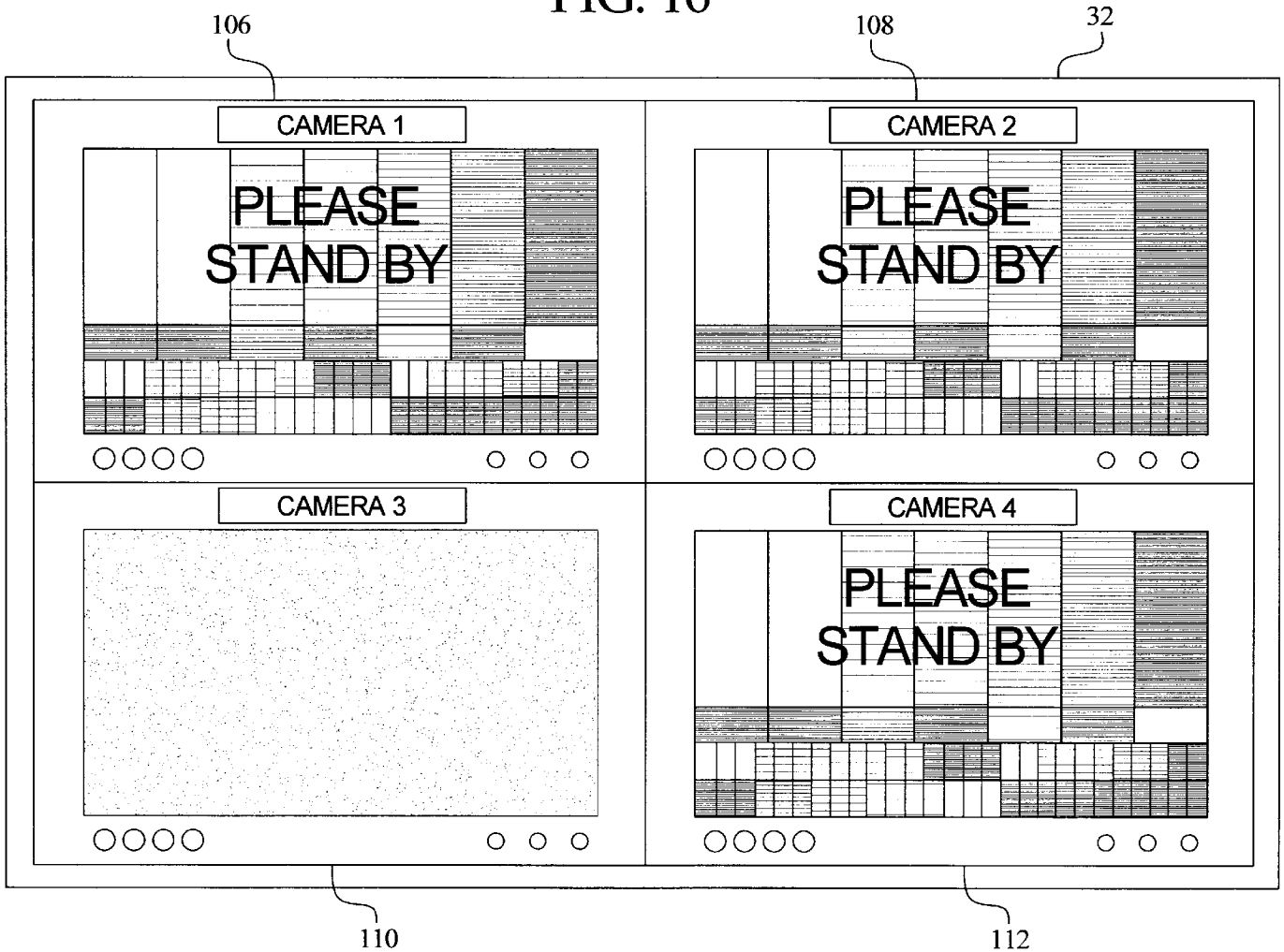
FIG. 16 is a front plan view of the display device illustrating a first set of screens of one embodiment of the present invention.

Referring to FIG. 16, one screenshot of the display device 32 is shown containing four screens 106, 108, 110 and 112. Screens 106, 108 and 112 illustrate the combination 66 of FIG. 5, wherein different screens contain the same view, i.e., the "Please Stand By" indicia and test pattern backgound, of the same time of the event, i.e., before the countdown begins. All four screens illustrate the combination 74 of FIG. 5, wherein different screens display different views of the same time of the event. All four screens are computer generated images programmed into the controller of the gaming device.

Figure 17:
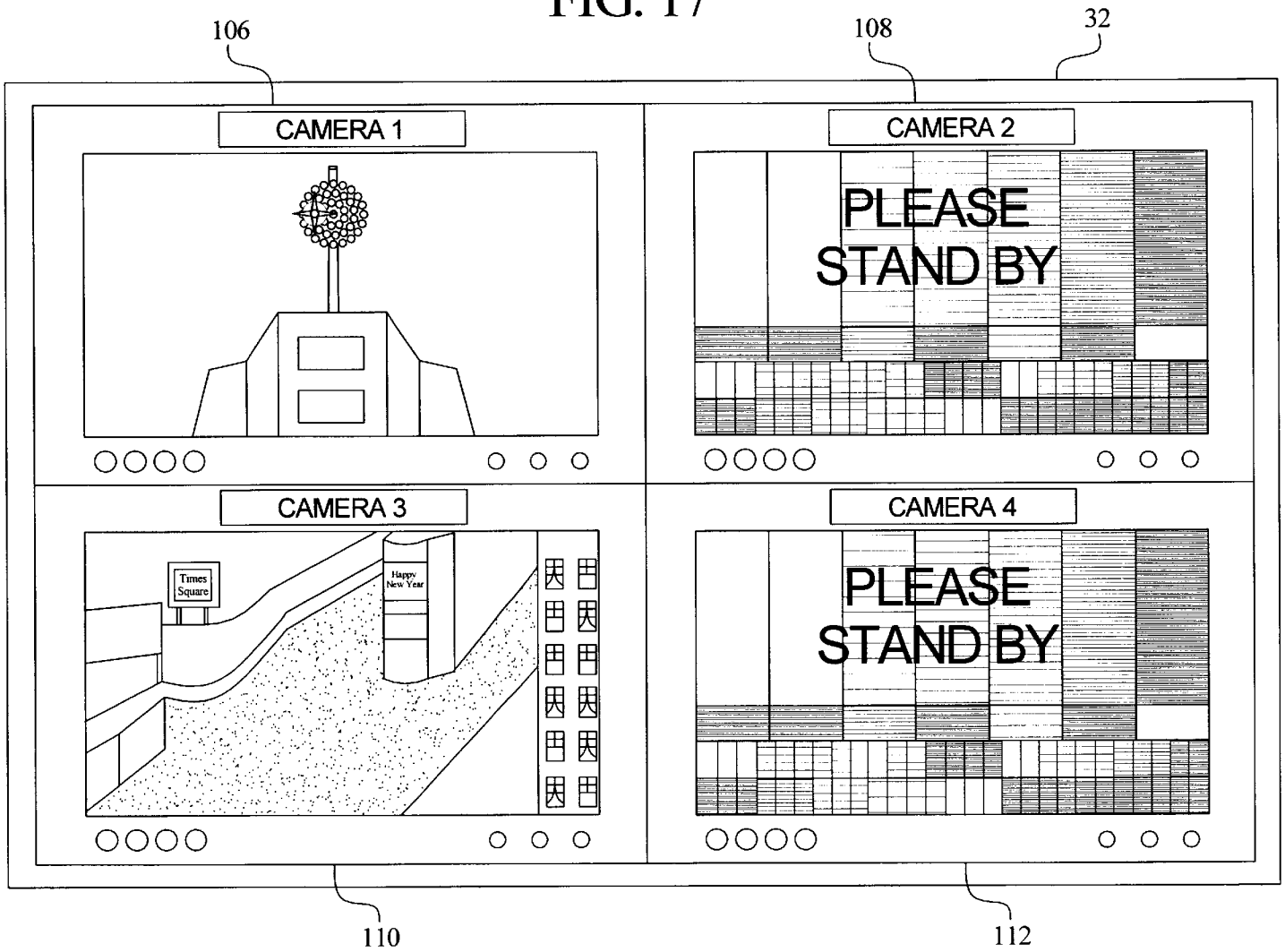
FIG. 17 is a front plan view of the display device illustrating a second set of screens of one embodiment of the present invention.

Referring to FIG. 17, a second screenshot of the display device 32 is shown, wherein the game has changed the view of screen 106 to a video of the New Year's Eve Bail and the view of screen 110 to a video clip of Times Square, wherein thousands of people wait to usher in the New Year. FIG. 17 illustrates the combination 74 wherein the different screens display different views of the same time in the event. That is, the screen 106 shows the Ball as the people in Times Square in screen 110 are viewing it.

Figure 18:
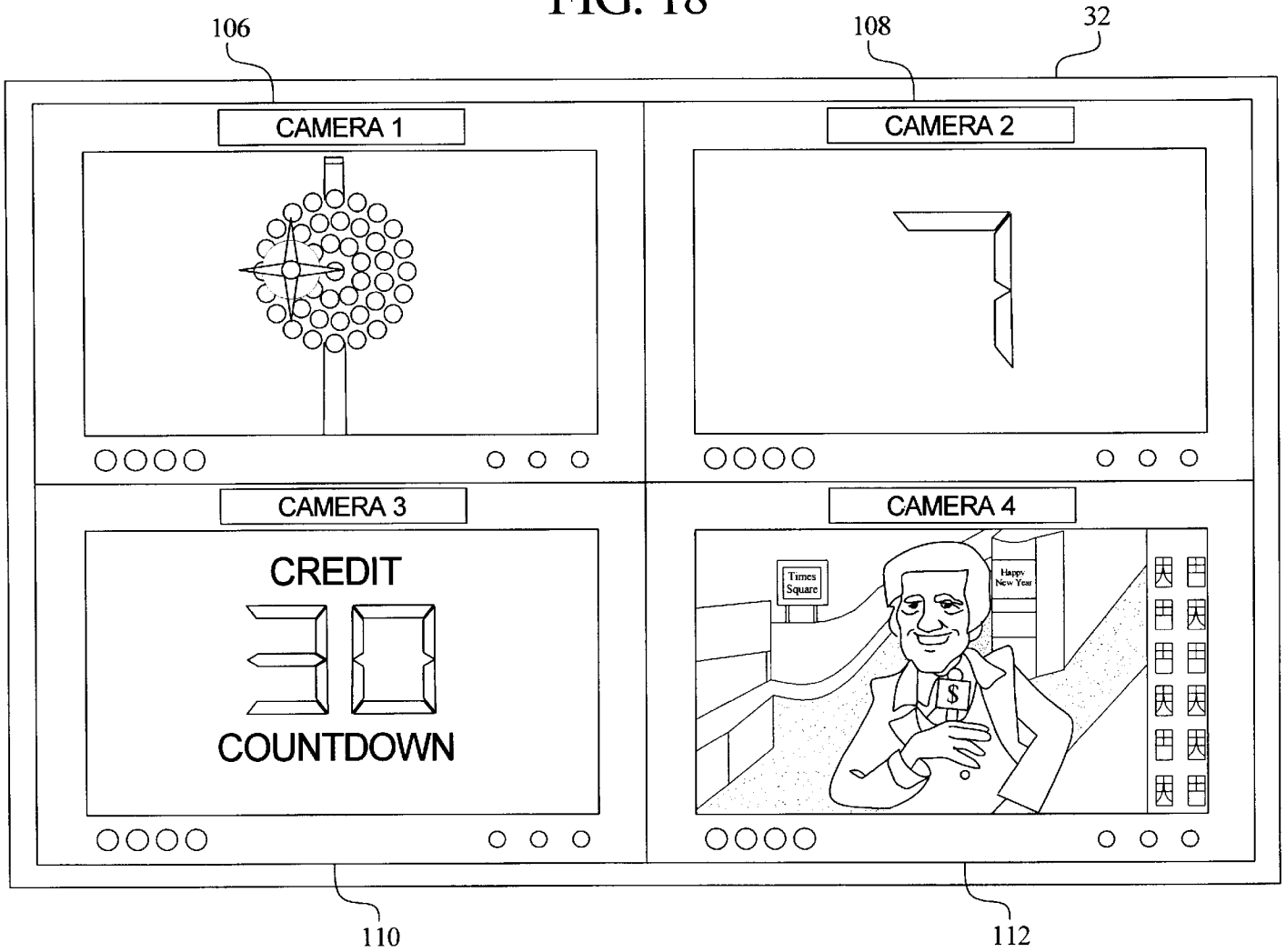
FIG. 18 is a front plan view of the display device illustrating a third set of screens of one embodiment of the present invention.

Referring to FIG. 18, a third screenshot of the display device 32 is shown, wherein the game has changed the view of all four screens in the bonus round and awards bonus credits in accordance with the theme. The game still maintains simultaneous views (employing the combination 74 in the display of FIG. 17), wherein each screen displays the same time of the event. The screen 112 displays a celebrity and the speakers emit his voice saying, "Hey, the excitement is rising here in Times Square. The ball is about to drop, the New Year's on it's way in just a few seconds from now. Keep your eye on the ball. Here we go with . . . " At this point in time Screen 108 begins to count down 1-9-8-7-6-5-4-3-2-1 as the ball in screen 106 sparkles (indicating that it is moving or dropping) and as the screen 110 randomly generates and displays possible awards. FIG. 18 contains two computer generated screens and two video clips.

Figure 19:
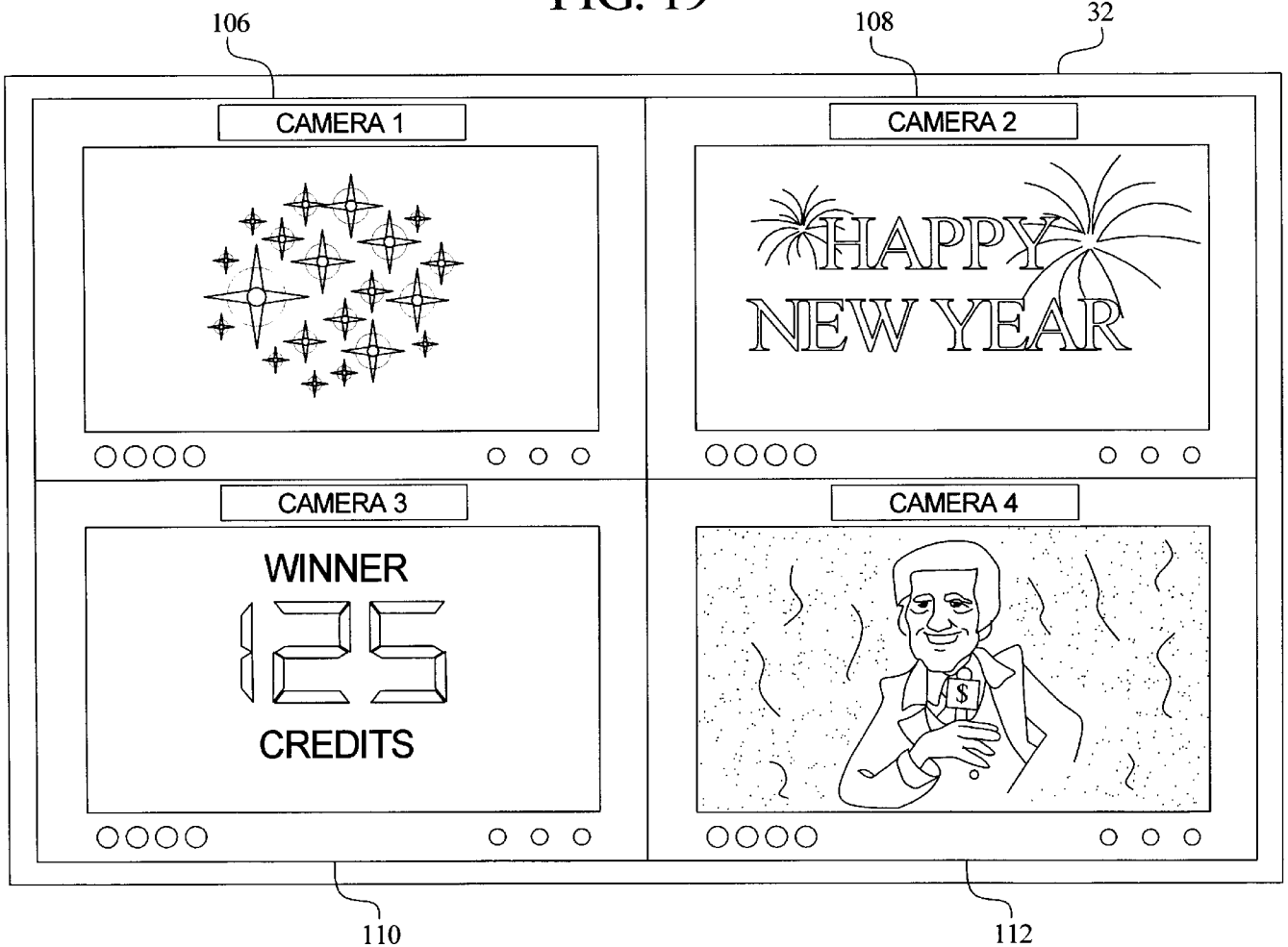
FIG. 19 is a front plan view of the display device illustrating a fourth set of screens of one embodiment of the present invention.
Figure 2:
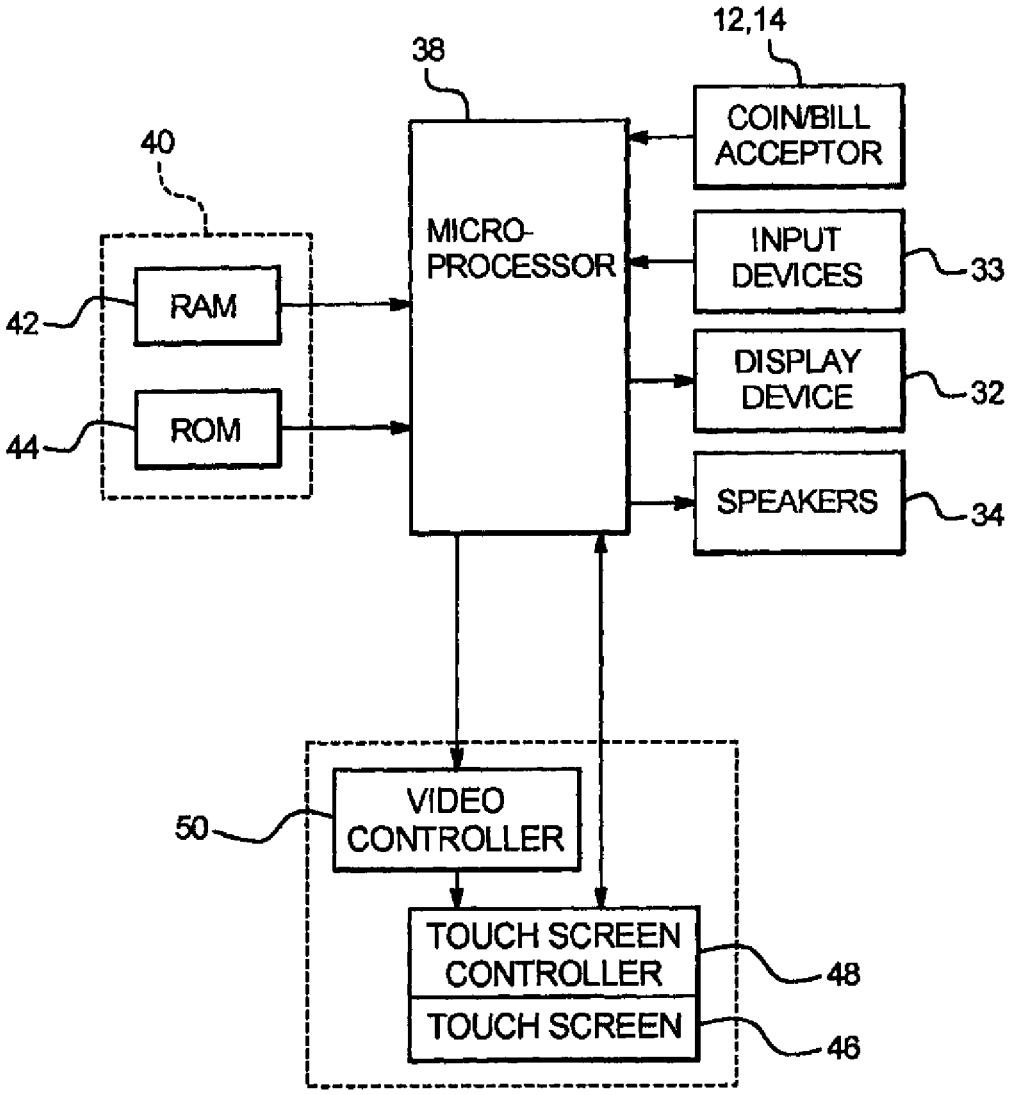

FIG. 19 displays the player's award, which is the randomly generated and displayed value as the countdown reaches zero. The present invention contemplates any suitable method of generating and displaying the award, which preferably coincides or accompanies the event or theme as illustrated here. FIG. 19 illustrates an example of the combination 76, wherein different screens display different views of different times in the event. Screens 106, 108 and 110 have frozen and show a frozen glitter pattern in screen 106, the "Happy New Year" indicia in screen 108 and the winning credits in screen 110 as of the second that the New Year began. Screen 112 continues to rap up the event and advance time, wherein the celebrity says, "Hey, it's been a great time here. Thanks for joining us. We'll see you the next time. For now, good night."

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is hereby claimed as follows:

1. A gaming device having a bonus round, said gaming device comprising:

a controller;

a display connected to said controller;

a plurality of proportionally equally sized screens simultaneously displayed by said display during the bonus round;

an event simultaneously displayed in at least two of said proportionally equally sized screens during the bonus round, wherein at least two of the screens simultaneously display different views of said event, wherein one of said views of said event includes a determination of an award generated by the controller from a plurality of different awards and one of said views includes a counting to a predetermined end time; and wherein said award is provided to the player.

2. The gaming device of claim 1, which includes a different event displayed in another of the plurality of proportionally equally sized screens.

3. The gaming device of claim 1, wherein said views are selected from the group consisting of motion pictures, motion animations, computer generated images, still photographs and still animations.

4. The gaming device of claim 1, wherein one of said proportionally equally sized screens, after the simultaneous display of said event, sequentially displays different images of the event occurring at a same time.

5. The gaming device of claim 1, wherein one of said proportionally equally sized screens, after the simultaneous display of said event, sequentially displays the event, occurring at different times.

6. The gaming device of claim 1, wherein a plurality of said proportionally equally sized screens, after the simultaneous display of said event, simultaneously display different events, said events occurring at a same time.

7. The gaming device of claim 1, wherein a plurality of said proportionally equally sized screens, after the simultaneous display of said event, simultaneously display different events, said events occurring at a plurality of different times.

8. A method for playing a bonus round of a gaming device, said method comprising:

(a) triggering said bonus round;

(b) simultaneously displaying a plurality of proportionally equally sized screens in a display of said gaming device;

(c) simultaneously displaying a same event in at least two of the proportionally equally sized screens of said display of the gaming device, wherein at least one of the screens displays a determination of an award related to said event and generated by the controller from a plurality of different awards and another one of said screens displays a counting to a predetermined end time related to said event; and (d) providing the award to a player.

9. The method of claim 8, wherein displaying in at least two of the screens of said display includes displaying a portion of the event in a sequential manner.

10. The method of claim 8, which includes the step of displaying the same view of said event at a plurality of different times of said event in one of the proportionally equally sized screens of said display.

11. The method of claim 8, which includes the step of displaying the same view of said event at a plurality of different times of said event in a plurality of the proportionally equally sized screens of said display.

12. The method of claim 8, which includes the step of displaying a plurality of different views of said event at a same time of said event in one of the proportionally equally sized screens of said display.

13. The method of claim 8, which includes the step of displaying a plurality of different views of said event at a same time of said event in a plurality of the proportionally equally sized screens of said display.

14. The method of claim 8, which includes the step of displaying a plurality of different views of said event at a plurality of different times of said event in a plurality of the proportionally equally sized screens of said display.

15. The method of claim 8, which includes the step of displaying a plurality of different views of said event at a plurality of different times of said event in one of the proportionally equally sized screens of said display.

16. A gaming device comprising:

a wagering game which includes a triggering event;

at least one award indicator;

at least one countdown indicator;

at least one display device operable to simultaneously display a plurality of screens, wherein the screens are adapted to simultaneously display said award indicator and said countdown indicator; and a processor operable with the display device to simultaneously display the plurality of screens upon said triggering event, to simultaneously display the award indicator and the countdown indicator in the screens, to count from a first number to a second number, to cause said countdown indicator to display said counting in one of the screens from the first number to the second number, and while the countdown indicator is displaying the counting from the first number to the second number, to cause the award indicator to display a first award changing to at least one second different award in another of the screens.

17. The gaming device of claim 16, wherein said second award is provided to the player.

18. The gaming device of claim 16, wherein said first number has a higher value than said second number.

19. The gaming device of claim 16, wherein said second number has a higher value than said first number.

20. The gaming device of claim 16, wherein said award indicator displays a plurality of awards during said counting from said first number to said second number.

21. The gaming device of claim 16, which includes at least one other image being simultaneously displayed on at least one other of the plurality of screens.

22. The gaming device of claim 16, which includes at least one event being simultaneously displayed in at least one other of the plurality of screens.

23. The gaming device of claim 16, which includes at least one event being simultaneously displayed in at least two other of the plurality of screens.

24. The gaming device of claim 23, which includes the step of displaying the same view of said event at a same time of said event in a plurality of the screens of said display.

25. The gaming device of claim 23, which includes the step of displaying the same view of said event at a plurality of different times of said event in one of the screens of said display.

26. The gaming device of claim 23, which includes the step of displaying the same view of said event at a plurality of different times of said event in a plurality of the screens of said display.

27. The gaming device of claim 23, which includes the step of displaying a plurality of different views of said event at a same time of said event in one of the screens of said display.

28. The gaming device of claim 23, which includes the step of displaying a plurality of different views of said event at a same time of said event in a plurality of the screens of said display.

29. The gaming device of claim 23, which includes the step of displaying a plurality of different views of said event at a plurality of different times of said event in a plurality of screens of said display.

30. The gaming device of claim 23, which includes the step of displaying a plurality of different views of said event at a plurality of different times of said event in one of the screens of said display.

31. A gaming device comprising of:

a plurality of award indicators;

at least one award;

at least one display device operable to simultaneously display a plurality of proportionally equally sized screens, wherein at least two of the proportionally equally sized screens are adapted to display said plurality of award indicators; and a processor operable with the display device to simultaneously display the plurality of proportionally equally sized screens, to simultaneously display the plurality of award indicators in at least two of the plurality of proportionally equally sized screens, to cause at least one of the award indicators to statically display said award, to cause at least one other of the award indicators to dynamically display said award, to simultaneously display a counting to a predetermined time in another one of the plurality of proportionally equally sized screens and provide the award to a player.

32. The gaming device of claim 31, which includes at least one image being simultaneously displayed on at least one other of the plurality of proportionally equally sized screens.

33. The gaming device of claim 31, which includes at least one event being simultaneously displayed in at least one other of the plurality of proportionally equally sized screens.

34. The gaming device of claim 31, which includes at least one event being simultaneously displayed in at least two other of the plurality of proportionally equally sized screens.

35. The gaming device of claim 34, which includes the step of displaying the same view of said event at a same time in a plurality of the proportionally equally sized screens of said display.

36. The gaming device of claim 34, which includes the step of displaying the same view of said event at a plurality of different times of said event in one of the proportionally equally sized screens of said display.

37. The gaming device of claim 34, which includes the step of displaying the same view of said event at a plurality of different times of said event in a plurality of the proportionally equally sized screens of said display.

38. The gaming device of claim 34, which includes a step of displaying a plurality of different views of said event at a same time of said event in one of the proportionally equally sized screens of said display.

39. The gaming device of claim 34, which includes the step of displaying a plurality of different views of said event at a same time of said event in a plurality of the proportionally equally sized screens of said display.

40. The gaming device of claim 34, which includes the step of displaying a plurality of different views of said event and a plurality of different times of said event in a plurality of the proportionally equally sized screens of said display.

41. The gaming device of claim 34, which includes the step of displaying a plurality of different views of said event at a plurality of different times of said event in one of the proportionally equally sized screens of said display.

42. The gaming device of claim 31, which includes a plurality of awards, wherein the processor causes each indicator to simultaneously display one of said plurality of awards.

43. A method of operating a gaming device with a wagering game, the method comprising the steps of:

(a) upon a triggering event, simultaneously displaying a plurality of screens in a display device of said gaming device;

(b) counting from a first number to a second number;

(c) displaying at least one award indicator in at least one of the screens wherein said award indicator displays a first award changing to at least one second different award, and simultaneously displaying a counting indicator in at least one other of the screens wherein the counting indicator is displaying said counting from the first number to the second number; and (d) upon the counting indicator reaching said second number, providing an award associated with the award indicator to the player.

44. The method of claim 43, wherein said first number has a higher value than said second number.

45. The method of claim 43, wherein said second number has a higher value than said second number.

46. The method of claim 43, which includes simultaneously displaying with the award indicator and the counting indicator an event in at least one other of the plurality of screens.

47. The method of claim 46, wherein a plurality of the screens are simultaneously displaying at two least different views of said event.

48. The method of claim 43, which includes simultaneously displaying with the award indicator and the counting indicator at least one other image in at least one other of the plurality of screens.

49. The method of claim 43, wherein the award indicator displays a plurality of awards during the counting indicator displaying said counting from the first number to the second number.

50. A method of operating a gaming device, the method comprising the steps of:

(a) simultaneously displaying a plurality of proportionally equally sized screens in a display device of said gaming device;

(b) simultaneously displaying (i) a plurality of award indicators in at least two of the proportionally equally sized screens, wherein one of the award indicators statically displays an award, and the other award indicator dynamically displays said award, and (ii) a counting to a predetermined end time in another of the proportionally equally sized screens; and (c) providing the award associated with the award indicator to the player.

51. The method of claim which includes simultaneously displaying with the award indicator and the counting indicator an event in at least one other of the plurality of proportionally equally sized screens.

52. The method of claim 50, wherein a plurality of the proportionally equally sized screens are simultaneously displaying at least two different views of said event.

53. The method of claim 50, which includes simultaneously displaying with the award indicator and the counting indicator at least one other image and at least one other of the plurality of proportionally equally sized screens.

* * * * *

UNITED STATES PATENT AND TRADEMARK OFFICE

CERTIFICATE OF CORRECTION

PATENT NO. : 6,780,105 B1
DATED : August 24, 2004
INVENTOR(S) : Joseph E. Kaminkow It is certified that error appears in the above-identified patent and that said Letters Patent is hereby corrected as shown below:

Column 9,
Line 55, change “Bail” to -- Ball --.

Column 10,
Line 6, change “1” to -- 10 --.

Column 11,
Line 24, insert -- event -- after “displaying”.

Signed and Sealed this

Eighth Day of February, 2005

JON W. DUDAS
*Director of the United States Patent and Trademark Office*

UNITED STATES PATENT AND TRADEMARK OFFICE

CERTIFICATE OF CORRECTION

PATENT NO. : 6,780,105 B1
APPLICATION NO. : 09/629235
DATED : August 24, 2004
INVENTOR(S) : Joseph E. Kaminkow It is certified that error appears in the above-identified patent and that said Letters Patent is hereby corrected as shown below:

IN THE DRAWINGS:

Please replace Figure 2 with the attached replacement Figure 2.

Signed and Sealed this

Twenty-third Day of June, 2009

JOHN DOLL
*Acting Director of the United States Patent and Trademark Office*